US005131788A

United States Patent [19]

Hulicsko

[11] Patent Number: 5,131,788

[45] Date of Patent: Jul. 21, 1992

[54] MOBILE POTHOLE PATCHING VEHICLE

[76] Inventor: Leslie Hulicsko, 137 Westfield Drive, Regina, Saskatchewan, Canada

[21] Appl. No.: 590,306

[22] Filed: Sep. 28, 1990

[51] Int. Cl.[5] ..... E01C 19/18; E01C 23/08; E01C 23/12

[52] U.S. Cl. ..... 404/108; 404/90; 404/92

[58] Field of Search ..... 404/90-96, 404/108-110

[56] References Cited

U.S. PATENT DOCUMENTS

| | | | |
|---|---|---|---|
| 3,217,620 | 11/1965 | Mindrum et al. | 404/108 X |
| 3,967,913 | 7/1976 | Gabriel. Jr. | 404/109 |
| 4,493,585 | 1/1985 | Axer | 404/102 |
| 4,502,813 | 3/1985 | Hojberg | 404/102 |
| 4,557,626 | 12/1985 | McKay et al. | 404/106 X |
| 4,571,119 | 2/1986 | Jones et al. | 404/96 |
| 4,678,363 | 7/1987 | Sterner | 404/75 |
| 4,765,772 | 8/1988 | Benedetti et al. | 404/7 |
| 4,784,518 | 11/1988 | Cutler | 404/79 |
| 4,830,533 | 5/1989 | Miller | 404/109 X |
| 5,015,120 | 5/1991 | Brock et al. | 404/108 |

*Primary Examiner*—Thuy M. Bui
*Assistant Examiner*—Nancy P. Connolly
*Attorney, Agent, or Firm*—Barrigar & Oyen

[57] ABSTRACT

A mobile, self propelled pothole patching vehicle is provided having a truck chassis and cab. The pothole patching vehicle includes an asphalt conveyor system for delivering asphalt to the road surface from a storage hopper mounted on the chassis. The conveyor system is uncoupled from the hopper and is movable with respect to the rest of the vehicle both longitudinally along the axis of the vehicle and transversely in a side-to-side swivelling motion. The conveyor is provided with a conveyor housing having a slotted top panel through which the asphalt passes into the conveyor interior. A conveyor mount slidably receives the conveyor and is pivotally coupled to the discharge port and the chassis for lateral swivelling motion of the extendible conveyor. During longitudinal and lateral movement of the conveyor, the discharge port opening into the housing interior remains within the ambit of the slotted portion of the top panel for continuous delivery of asphalt. The pothole patching vehicle of the present invention also includes a heated tamper for providing a smooth finish to the freshly packed asphalt and which minimizes asphalt sticking to the tamper. The heated tamper is also utilized to heat air from a compressed air source for pre-drying potholes before being filled.

26 Claims, 4 Drawing Sheets

MOBILE POTHOLE PATCHING VEHICLE

FIELD OF THE INVENTION

This invention relates to mobile, self propelled pothole repair vehicles utilizing a conveyor for delivering asphalt to a roadway for compacting the asphalt in the pothole.

BACKGROUND OF THE INVENTION

Typical self-propelled pothole patching vehicles are provided with a cab and a chassis adapted to carry an asphalt storage hopper, a conveyor for transporting the asphalt front the hopper to the roadway and a tamping means for compacting the asphalt into the pothole, either of the roller type or a flat tamping plate provided with a vibrator.

Some pothole patching vehicles have a front asphalt delivery system for delivering asphalt to the pothole within the field of view of the operator. Some of these conveyor systems are adapted to be longitudinally extendible and retractible along the vehicle axis in addition to swivelling or pivoting laterally. However, since the hopper-to-conveyor connection must be maintained for continuous delivery of asphalt during the patching process, in some vehicles the conveyor is coupled to the hopper in such a way that both the conveyor and hopper move together in tandem during extendible and retractible motion thereof.

This arrangement is not entirely satisfactory since coupling the hopper and conveyor in this way limits the longitudinal range accessible to the conveyor, depending on the chassis design. As a result, having to continuously move the vehicle between potholes tends to slow down the pothole patching process.

It is customary to provide pothole patching vehicles with various accessories for preparing the pothole prior to filling, some examples being flame torches for drying the pothole, compressed air for blowing loose debris out of the pothole and tack oil spraying means for coating the pothole prior to filling in order to increase the bonding between the new and old asphalt.

It has been found that direct flame heating of the asphalt on the pothole interior can damage the asphalt thereby degrading its ability to bond to the new asphalt. It has also been found that when tamping the asphalt after the pothole has been filled, asphalt tends to stick to the tamping plate, which prevents a smooth and continuous road surface from being achieved. Also, the asphalt must be continuously cleaned off the tamping plate, otherwise, once it dries and hardens, it becomes very difficult to clean off.

SUMMARY OF THE INVENTION

The subject provides a mobile pothole patching vehicle utilizing an asphalt conveyor uncoupled from the hopper which overcomes the disadvantage of the prior art. The mobile pothole patching vehicle of the present invention utilizes a heater which is employed not only to heat the tamping plate which compacts the fresh asphalt but, also to produce a stream of heated air for the pre-drying potholes prior to being filled.

The pothole patching vehicle of the present invention includes a truck chassis and cab, an asphalt storage hopper and a conveyor means mounted below and forwardly of the hopper for delivery of asphalt to the road surface. An asphalt dispensing means extends from the hopper to a dispensing port opening into the conveyor.

The pothole patching vehicle is provided with a conveyor pivoting means for slidably receiving the conveyor which is pivotally coupled to the chassis below the discharge port and includes an access opening in alignment with the discharge port to permit asphalt to be dispensed onto the conveyor through the dispensing port. Provided is a conveyor pivoting means coupled to the chassis for slidably receiving the conveyor means, on rollers or otherwise, and for side-to-side pivoting motion of the conveyor about a vertical axis in alignment with the discharge port. There is provided a conveyor extension means for extensible and retractible motion of the conveyor means with respect to the rest of the vehicle.

The conveyor housing may include a top panel having a slotted portion situated generally below the discharge port and wherein the discharge port remains within the ambit of the slotted portion during full extensible motion of the conveyor means.

In another aspect of the invention, the mobile pothole patching vehicle of the present invention comprises tamper means coupled to the conveyor means and movable therewith including means for vibrating the tamper for compacting the freshly laid asphalt. The tamper comprises contiguous lower and upper air chambers in thermal contact. The upper air chamber is connected to a compressed air source at one end and operably coupled to an air nozzle at the other end for blowing loose debris out of the pothole prior to filling. The tamper is provided with a heating means for heating both tamper air chambers, with the heated lower chamber heating the tamper plate on the tamper bottom in order to give a smooth finish to the asphalt patch while the heated upper chamber is utilized to heat the air stream passing therethrough thereby providing a heated air flow for blow drying the pothole prior to filling.

BRIEF DESCRIPTION OF THE DRAWINGS

A preferred embodiment of the invention will now be described by way of example with reference to the accompanying drawings, in which.

DETAILED DESCRIPTION OF THE PREFERRED EMBODIMENT

Figure 1:
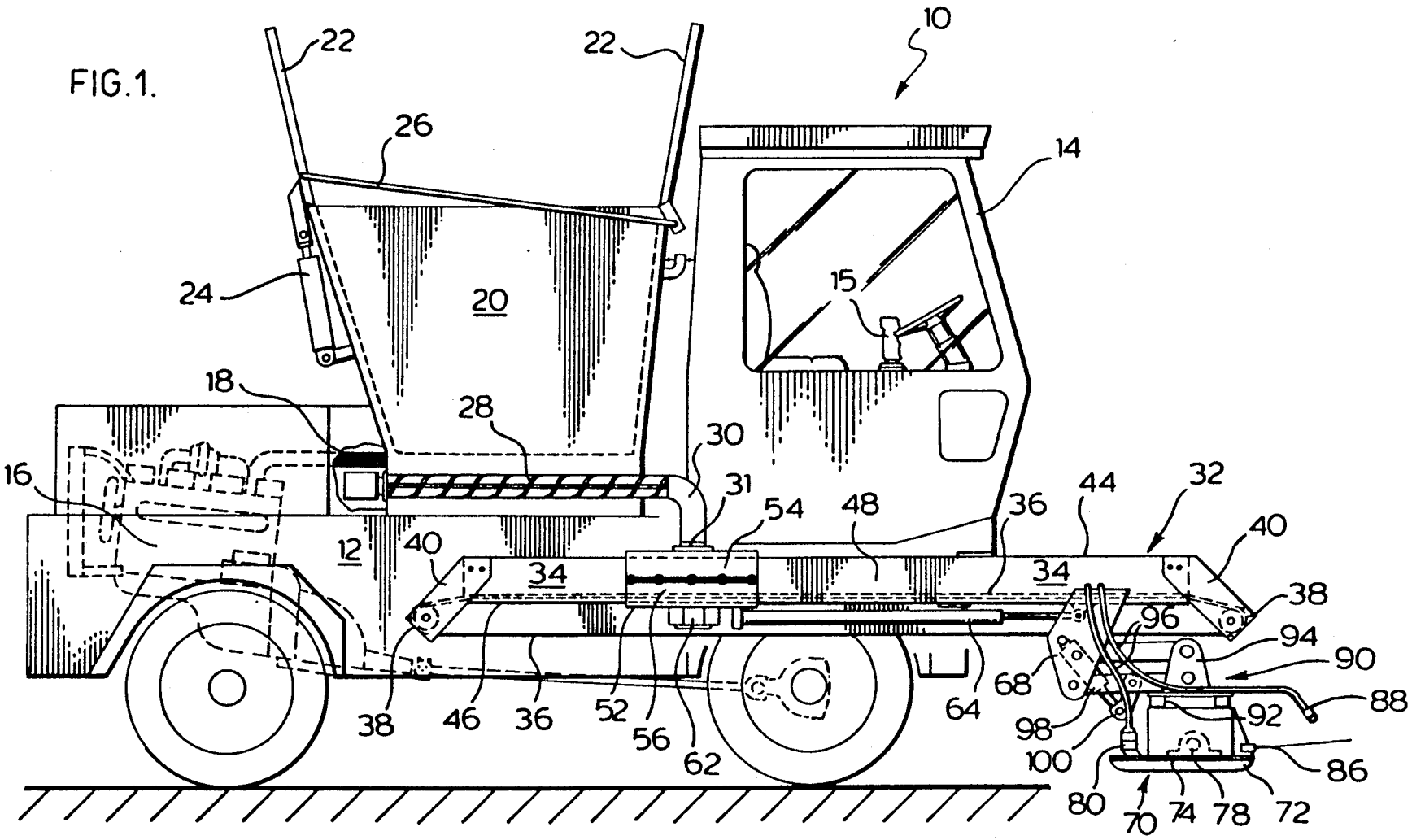
FIG. 1 is a side elevation view of a mobile pothole repair vehicle embodying the subject invention.

FIG. 1 illustrates a mobile pothole patching vehicle 10 embodying the subject invention. Pothole repair vehicle 10 utilizes a production truck chassis comprising a frame 12, a cab 14, an engine 16, an engine exhaust pipe 18 and a drive train (not shown in detail). Cab 14 is provided with a joystick 15 for control of the pothole patching functions to be discussed presently. Mounted onto production truck frame 12 is a hopper 20 which includes a pair of hopper lids 22, a hopper lid hydraulic cylinder 24 and a hopper lid arm 26 pivotally connected to lids 22. Hopper 20 is provided with an asphalt auger 28 extending along its bottom through an opening in the bottom of the hopper into cylindrical L-shaped dispensing tube 30 which in turn terminates at a dispensing port 31. Mounted below cab 14 and hopper 20 and extending forwardly is a conveyor 32 which consists of a conveyor housing 34, a conveyor belt 36 and a pair of conveyor belt rollers 38 each rotatably mounted in brackets 40 attached to each of the ends of house 34.

Figure 2:
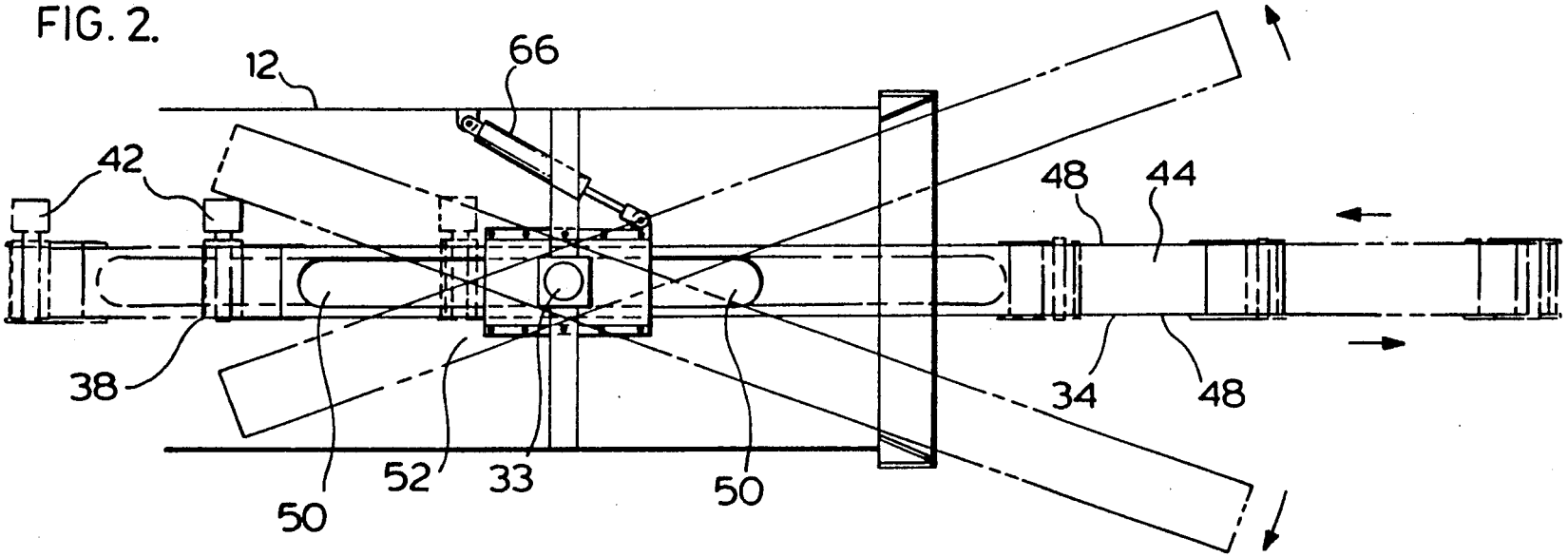
FIG. 2 is a plan view of the conveyor means of the present invention.

Referring to FIG. 1 and 2, conveyor 32 is also provided conveyor belt 36. Conveyor housing 34 is rectangular in shape and includes an upper panel 44, a lower panel 46 and a pair of side panels 48. Upper housing panel 44 has a slotted portion 50 extending longitudinally along panel 44 which is wider than the diameter of dispensing port 31. Conveyor belt 36 is looped around rollers 38 and lower panel 46 and slide forwardly along panel 46 when engaged by conveyor motor 42.

Figure 3:
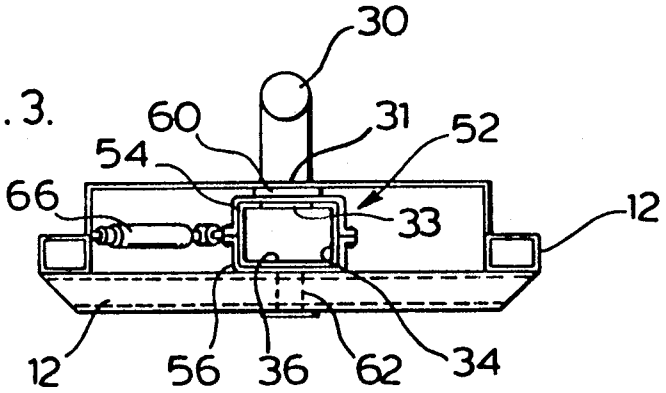
FIG. 3 is a partial rear elevation view illustrating the conveyor housing and the conveyor pivot means of a pothole repair vehicle embodying the subject invention.

Referring now to FIGS. 1, 2 and 3, a fixed pivot mount 52 for conveyor 32 peripherally encloses a portion of conveyor housing 34. Pivot mount 52 includes a top section C-shaped flange 54 and a bottom C-shaped flange 56 which are secured together on either side of housing 34. Top section 54 is provided with an access port 33 aligned with dispensing port 31. A top annular pivot bearing 60 is coupled to flange 54 and to horizontal frame element 120 thereby to permit conveyor 32 to pivot horizontally relative to frame element 120. The bearing 60 is concentric with access port 33 through which the end of dispensing tube 30 is inserted for pivotal connection to pivot mount 52. Pivot mount 52 is provided with a pivot shaft 62 which is welded to the bottom section C-shaped flange edge 56 and rotates in a bushing (not shown in detail) in a frame element 120, thereby coupling mount 52 to frame 12. Stop-cap prevents pivot shaft 62 from being drawn upwardly out of engagement with frame element 120. Conveyor 32 is slidingly guided by pivot mount 52 for forwardly and rearwardly extensible motion of conveyor 32 therein. Sliding may be accomplished by means of rollers or otherwise. The forwardly and rearwardly extensible motion of conveyor 32 is accomplished by means of a hydraulic cylinder 64 which extends longitudinally below housing 34 between pivot mount 52 and a bracket 132 fixed to the underside of the forwardly disposed portion of conveyor 32. Conveyor 32 [swivels pivots horizontally about the dispensing tube/pivot-mount pivotal coupling by means of a hydraulic cylinder 66 attached between frame 12 and one side of pivot mount 52.

The solid lines representing conveyor 32 in FIG. 2 illustrate conveyor 32 in the centred position wherein conveyor housing 34 is aligned along the longitudinal axis of vehicle 10 while being in the half extended (half retracted) position. In this position, slotted panel 44 is generally symmetric with respect to dispensing port 31. The broken lines extending generally longitudinally in FIG. 2 illustrate conveyor 32 in both the fully extended and the fully retracted position along the longitudinal axis of the vehicle. The angled broken lines depict the conveyor 32 fully pivoted to both the and right (in the centred position of extension) wherein dispensing port 31 is seen to remain within the ambit of slotted portion 50.

Referring now to FIGS. 1 and 4, conveyor housing 34 is provided with a pair of spaced, downwardly extending mounting arms 68 rigidly secured to housing side panels 48 and spaced rearwardly from the forwardly disposed end of conveyor 32. An asphalt tamper shown generally as 70 is spaced forwardly from the end of and suspended from connecting arms 96 pivotally connected housing 71 enclosing a lower air flow chamber 72 and a housing 73 enclosing an upper air flow chamber 74 situation on top of and in thermal contact with housing 71.

Figure 4A:
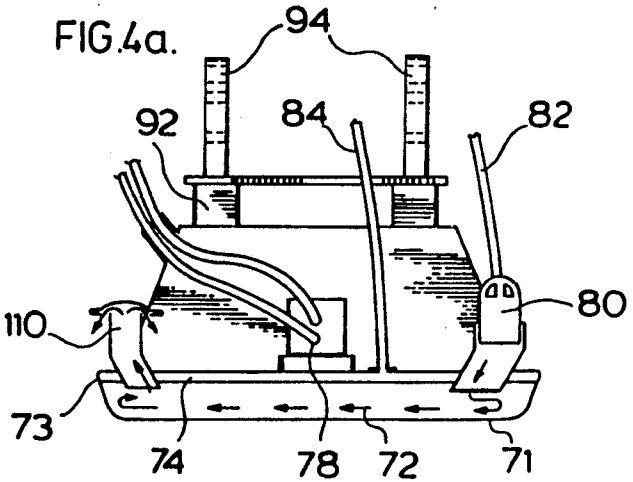
FIG. 4*a* is a rear elevation view of and embodiment of a tamper of the present invention.
Figure 4B:
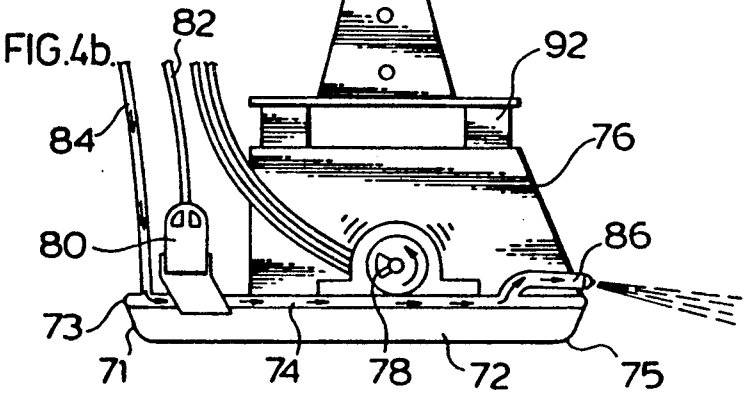
FIG. 4*b* is a side elevation view of the tamper of FIG. 4*a;*

FIGS. 4*a* and 4*b* illustrate a more detailed view of tamper 70, wherein housing 71 above tamping plate 75 encloses an air chamber 72 which is heated by a tiger torch 80 connected to one side of housing 71. A midsection 76 houses a hydraulic vibrator 78. Tiger torch 80 is supplied by propane via fuel line 82. An exhaust port 110 is located at the other side of section 72 from torch 80 for exhausting the combustion products. Housing 73 encloses upper air flow chamber 74 situated above and in intimate thermal contact therewith. An air line 84 supplies compressed air to chamber 74 while the pressurized and heated air is exhausted through air nozzle 86. A tack oil nozzle 88 is mounted in close proximity to air nozzle 86.

It will be appreciated that means other than a hydraulic motor may be employed for vibrating tamper 70. A compressed air driven pneumatic vibrator is one alternative while an electric powered vibrator is another. It will also be appreciated that the air nozzle and the tack oil nozzle may be mounted independent of the tamper means, for example being suspended directly from the conveyor means.

Tamper 70 is hung from mounting arms 68 by a tamper suspension means generally indicated by reference numeral 90. Tamper suspension means 90 includes rubber mounts 92 attached between tamper 70 and a tamper mounting bracket 94. Two pairs of connecting arms 96 are pivotally coupled to tamper mounting bracket 94 and to mounting arms 68. Tamper 70 is upwardly, and downwardly movable with respect to conveyor 32 by means of a hydraulic cylinder 98 attached between mounting arm 68 and one end of a bracket 100, the other end of which is pivotally coupled to connecting arm 96.

Figure 5:
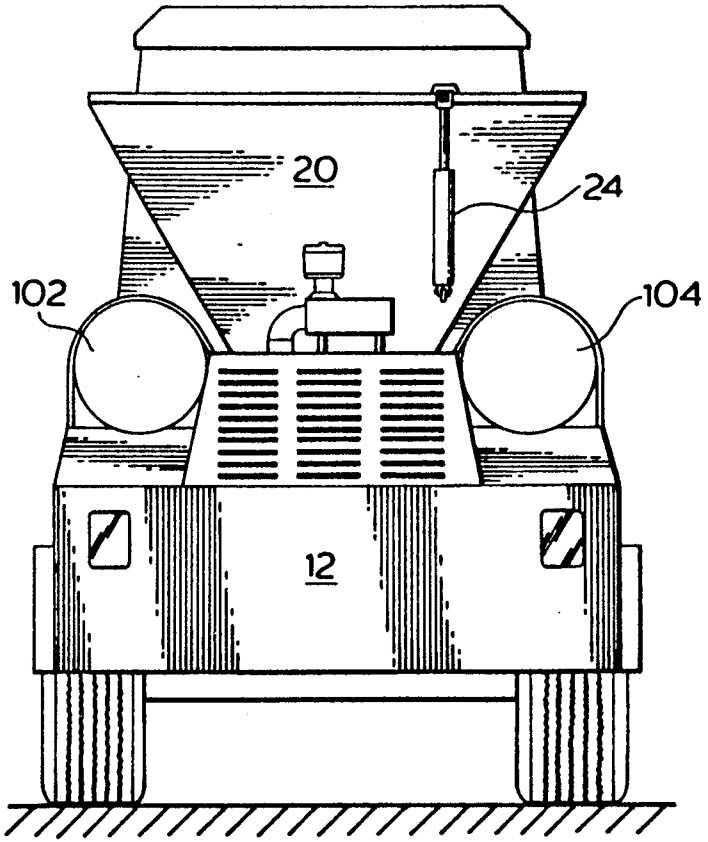
FIG. 5 is a rear elevation view of the pothole repair vehicle of the present invention.

Referring now to FIG. 5, a propane storage tank 102 is mounted on frame 12 and supplies propane to the tiger torch while a compressed air tank 104 mounted on frame 12 supplies compressed air for the air nozzle. A tack oil storage tank (not shown is mounted on frame 12 for supplying tack oil to tack oil nozzle 88.

In operation, mobile pothole repair vehicle 10 is capable of storing and transporting a hopper full of asphalt. The asphalt may be heated by utilizing the heated exhaust from exhaust pipe 18 from engine 16. For pothole patching, vehicle 10 is positioned behind a pothole and conveyor 32 is displaced longitudinally and/or pivoted laterally as required until the end of conveyor 32 is appropriately positioned with respect to the pothole. The conveyor is positioned so that air nozzle 86 is aimed at the pothole. The compressed air is turned on and the air flow directed at the pothole to clean out any loose debris. If the pothole is wet or has water therein, a heated air flow is used by turning on tiger torch 80 and the resulting hot air flow directed at the pothole until it is dry enough to be filled. Following this, tack oil nozzle 88 is directed at the pothole and the interior of the pothole sprayed with tack oil. Conveyor 32 is then first positioned so that the end portion is centrally located over the pothole and then turned on along with the asphalt auger 28. Asphalt is driven along the hopper bottom by auger 28 and through dispensing tube 30 to dispensing port 31 where it is forced through pivot housing access port 33 and drops through slot 50 in upper panel 44 of conveyor 32 onto conveyor belt 36. The asphalt is delivered to the end of conveyor 32 whereupon it drops into the pothole. Upon filling the pothole, conveyor 32 and auger 28 are turned off. Conveyor 32 is then repositioned over the pothole by extending it until tamper 70 is directly over the freshly filled pot hole. Tamper 70 is then dropped to the road surface by activating hydraulic cylinder 98. The loose asphalt is then compressed by tamper 70 by engaging hydraulic vibrator 78 until the desired level of compacting has been achieved. Tamper 70 is directly heated by tiger torch 80 during the compacting process in order to circumvent the problem of asphalt sticking to the tamping plate 75 on the bottom surface of housing 71. Upon completion of the compacting procedure, tamper 70 is raised from the road surface by means of hydraulic cylinder 98. Joystick 15 is used for controlling all the functions associated with the pothole patching procedure.

After the filling of one pothole is complete, the conveyor is then re-positioned over any other pothole within the ambit of the conveyor and the process repeated. The longitudinal dimension of slot 50 in upper housing 44 is sufficient to ensure that dispensing port 31 remains within the ambit of slot 50 for the full motion of conveyor 32 within the ambit defined by its extensible, retractible and pivoting motion. After the filing of all the potholes within the ambit of the conveyor, the conveyor is fully retracted and the vehicle moved to the next location and the process repeated.

Figure 6:
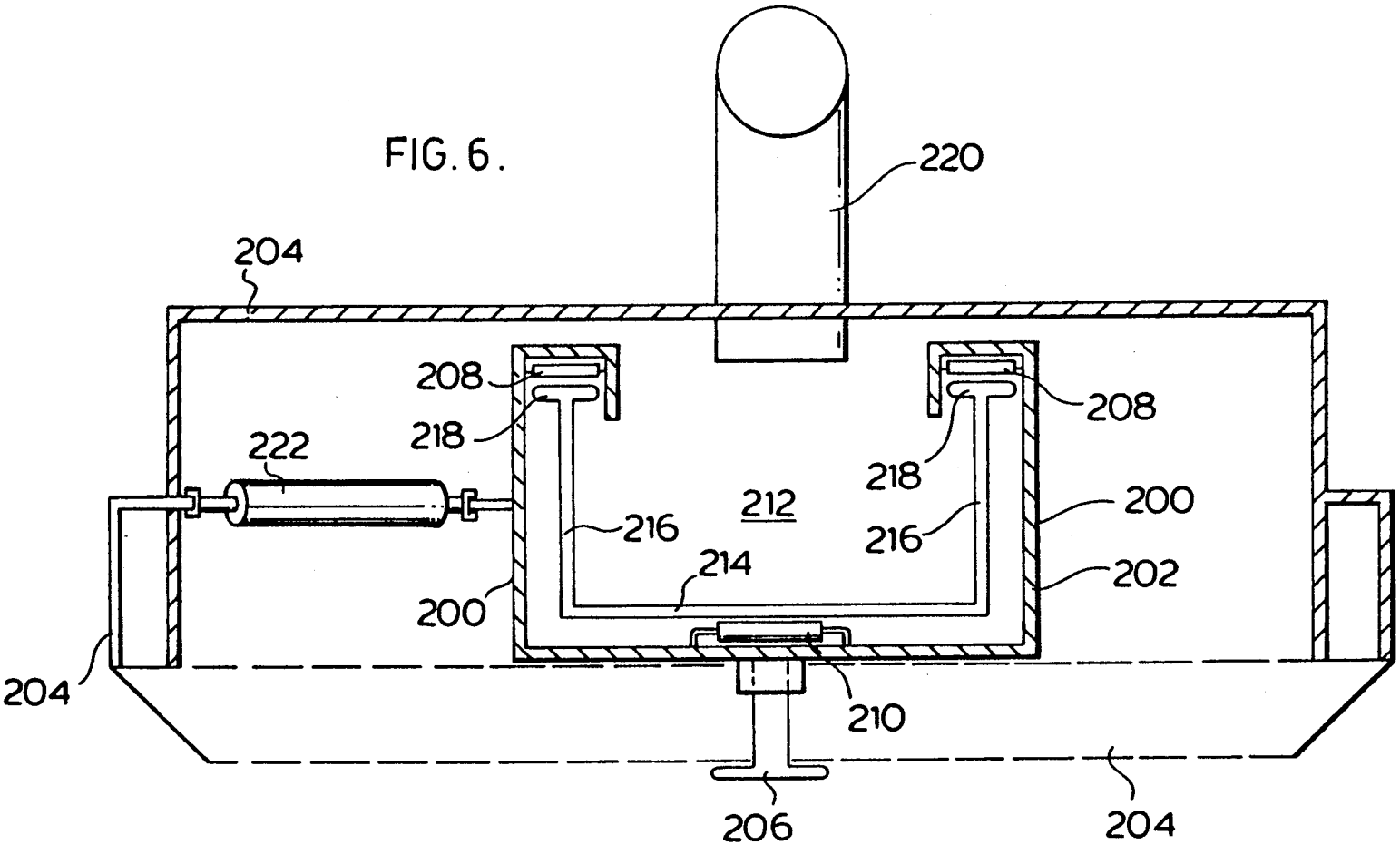
FIG. 6 is a partial repair elevation view of an alternative fixed swivel mount constructed according to the invention.

It should be appreciated that while the preferred embodiment of the subject pothole patching vehicle as illustrated and described above includes a conveyor having a housing with a slotted top panel, other types of conveyors coupled be utilized, with appropriate modifications of the pivot mount. FIG. 6 illustrates such an alternative embodiment wherein pivot mount 200 includes a bottom rectangular C-shaped flange 202 pivotally coupled to chassis 204 by pivot shaft 206. Flange 202 is provided with rollers 208 and 210. A conveyor is provided which includes bottom panel 214 and two side panels 216. The side panels 216 are each provided with upper T-shaped sections 218 for slidable motion along rollers 208 while bottom panel 214 moves slidably over roller 210. Dispensing port 220 opens into the interior of conveyor 212. Hydraulic cylinder 222 extending between chassis 204 and mount 200 acts to pivot mount 200 and hence conveyor 212 about the connection of pivot shaft 206 to mount 200. Extensible and retractible motion of conveyor 212 is accomplished by a second hydraulic cylinder (not shown) extending between mount 200 and the forwardly disposed portion of conveyor 212. Dispensing port 229 opens into the interior of conveyor 212 and remains within the ambit defined by conveyor 212 during longitudinal and lateral motion of the conveyor with respect to the rest of the vehicle.

While the present invention has been described and illustrated with respect to the preferred and alternative embodiments it will be appreciated that numerous variations of these embodiments may be made without departing from the scope of the invention, which is defined in the appended claims.

I claim:

1. A mobile, self-propelled pothole patching vehicle having a cab, a chassis, and front and rear support wheels, comprising:

a) a storage hopper mounted on the chassis for storing asphalt;

b) asphalt dispensing means connected to the hopper outlet and having a dispensing port for dispensing the asphalt from the hopper therethrough;

c) a conveyor mounted below and in vertical alignment with the dispensing port for receiving asphalt therefrom, said conveyor extending forwardly of the hopper for delivering and discharging asphalt forwardly to the roadway, said conveyor having a free discharge exit end protruding forwardly of the cab and front wheels;

d) a conveyor pivot mount attached to the chassis below the dispensing port and slidingly receiving the conveyor for pivoting the conveyor about a vertical axis while maintaining the conveyor in vertical alignment with the dispensing port;

e) conveyor extending and retracting means connected to the conveyor for extending and retracting the conveyor along the longitudinal axis thereof; and f) unitary pivoting means for pivoting the conveyor about said vertical axis.

2. A vehicle as defined in claim 1, wherein the conveyor pivot mount has an access opening in vertical alignment with the dispensing port to enable asphalt to be dispensed onto the conveyor through the dispensing port.

3. A pothole patching vehicle according to claim 2, wherein the conveyor comprises a conveyor housing having a bottom panel and a conveyor belt drivably and slidably movable over the bottom panel.

4. A pothole patching vehicle according to claim 3, wherein the conveyor housing includes a top panel having a longitudinally elongate slot located so that the dispensing port remains within the ambit thereof during extensible and retractible movement of the conveyor.

5. A pothole patching vehicle according to claim 4, wherein the conveyor pivot mount includes a housing disposed peripherally around and slidingly receiving the conveyor housing and provided with a top access port in alignment with the dispensing port for passage of asphalt therethrough.

6. A pothole patching vehicle according to claim 5, wherein the conveyor pivot mount comprises a top C-shaped flange and a bottom C-shaped flange attached to the top flange, and wherein the top flange is provided with said top access port; and wherein the bottom C-shaped flange is provided with a downwardly projecting shaft concentric with the annular bearing and pivotally mounted on the chassis for pivotal motion of the pivot mount relative to the chassis.

7. A vehicle as defined in claim 5, wherein the unitary pivoting means comprises a hydraulic piston and cylinder unit connected between the chassis and one end of the pivot mount housing.

8. A pothole patching vehicle according to claim 1, wherein the asphalt dispensing means includes a dispensing tube connected to the hopper means, and an asphalt auger for moving the asphalt through the dispensing tube to the dispensing port.

9. A pothole patching vehicle according to claim 1, further comprising a tamper connected to and suspended from the free end of the conveyor for compacting asphalt on the roadway.

10. A vehicle as defined in claim 9, wherein the tamper is located generally immediately rearwardly of the discharge exit of the conveyor.

11. A vehicle as defined in claim 9, wherein the tamper comprises a tamping plate and a housing extending from the periphery of and above the tamping plate, and means for supplying heated gas to the housing immediately above the tamping plate thereby to heat the tamping plate.

12. A vehicle as defined in claim 11, wherein the housing is provided with: an upper chamber and a lower chamber, the lower chamber being located immediately above the tamping plate and receiving said heated gas, the upper chamber being located immediately above and the lower chamber and being heated thereby, a source of supply of compressed air to the upper chamber, and an air discharge nozzle coupled to the upper chamber for discharging heated air therefrom to the roadway.

13. A vehicle as defined in claim 12, wherein the air discharge nozzle is disposed forwardly of the tamper and is generally forwardly and downwardly directed.

14. A vehicle as defined in claim 12, including a tamper vibrator connected to the tamper for imparting vibratory motion to the tamping plate.

15. A vehicle as defined in claim 10, wherein the tamper comprises a tamping plate and a housing above the tamping plate, and means for supplying heated gas to the housing immediately above the tamping plate thereby to heat the tamping plate.

16. A vehicle as defined in claim 15, wherein the housing is provided with: an upper chamber and a lower chamber, the lower chamber being located immediately above the tamping plate and receiving said heated gas, the upper chamber being located immediately above the lower chamber and being heated thereby, a source of supply of compressed air to the upper chamber, and an air discharge nozzle coupled to the upper chamber for discharging heated air therefrom to the roadway.

17. A vehicle as defined in claim 16, wherein the air discharge nozzle is disposed forwardly of the tamper and is generally forwardly and downwardly directed.

18. A vehicle as defined in claim 16, including a tamper vibrator connected to the tamper for imparting vibratory motion to the tamper plate.

19. A pothole patching vehicle according to claim 10, wherein the tamper includes tamper plate heating means to heat the tamper plate for providing a smooth finish to the compacted asphalt.

20. A mobile self propelled pothole patching vehicle mounted on a chassis supported by front and rear support wheels, said chassis supporting a cab, a source of compressed air, a tack oil storage tank and a fuel storage tank, said vehicle comprising:

a) a storage hopper mounted on the chassis for storing asphalt;

b) asphalt dispensing means for dispensing the asphalt from the hopper through a dispensing port;

c) a conveyor mounted below and forwardly of the hopper for delivering asphalt to a position on the roadway;

d) conveyor pivoting means coupled to the chassis below the dispensing port for slidingly receiving the conveyor and for pivoting the conveyor about a vertical axis in alignment with the dispensing port, including an access opening in vertical alignment with the dispensing port to enable asphalt to be dispensed onto the conveyor means through the dispensing port;

e) conveyor extending and retracting means coupled to the conveyor pivoting means and to the conveyor for slidingly extending and retracting the conveyor along the longitudinal axis thereof; and, f) a tamper operably coupled to the free end of the conveyor and movable therewith, including (i) a plate on the underside of the tamper for compacting the asphalt;

(ii) a vibrator for imparting vibratory motion to the plate;

(iii) a housing defining and enclosing a lower heated gas chamber above the tamper plate for heating the tamper plate, said housing defining and enclosing an upper air chamber therein immediately above the heated gas chamber and coupled to the compressed air source and provided wt an air discharge nozzle for blowing out compressed air from the upper chamber to expel loose debris from the roadway prior to depositing asphalt thereon, and wherein the two chambers are in contiguous thermal relationship so that the heated gas in the lower chamber heats the compressed air in the upper chamber; and (iv) suspension means positioned between the conveyor and the housing for damping vibrations of the tamper.

21. A pothole patching vehicle according to claim 20, wherein the tamper includes heating means to heat the gas in the lower chamber for providing heat to the tamper plate so as to facilitate the imparting of a smooth finish to the asphalt compacted by the tamper.

22. A pothole patching vehicle according to claim 21, further comprising a tack oil nozzle mounted to the conveyor and generally downwardly directed to spray the roadway in front of the tamper coupled to the tack oil storage tank for pre-treating the roadway prior to filling with asphalt.

23. A pothole patching vehicle according to claim 22, wherein the asphalt dispensing means includes a dispensing tube connected to the hopper outlet, and an asphalt auger for moving the asphalt through the dispensing the tube to the dispensing port.

24. A mobile self propelled pothole patching vehicle mounted on a chassis including a cab, and a source of compressed air, comprising:

a) storage hopper means mounted on the chassis for storing asphalt, a dispensing tube connected to the hopper means and an asphalt auger for moving the asphalt from the hopper means to a dispensing port through the dispensing tube;

b) conveyor means mounted below and forwardly of the hopper means for delivering asphalt to a position on the roadway, and wherein the conveyor means includes a housing having an upper panel provided with a slot;

c) conveyor pivoting means coupled to the chassis below the dispensing port for slidingly receiving the conveyor means and for pivoting the conveyor about a vertical axis in alignment with the dispensing port, including an access opening in alignment with the dispensing port to enable asphalt to be dispensed onto the conveyor means through the dispensing port;

d) conveyor extension means coupled to the conveyor pivoting means and the conveyor means for slidingly extending and retracting the conveyor means along the longitudinal axis thereof, and wherein the upper panel slot is long enough so that the dispensing port remains within the ambit thereof during extensible and retractible movement of the conveyor means; and e) tamper means operably coupled to the conveyor means and movable therewith, including vibration means for vibrating a tamper plate on the underside of the tamper means for compacting the asphalt, and suspension means for damping out the vibrations between the tamper means and the rest of the vehicle, and wherein the tamper means includes a first housing portion defining and enclosing a lower heated gas chamber immediately above the tamper plate, and a second housing portion defining and enclosing an upper air chamber immediately above the lower chamber, and coupled to the compressed air source for passing air therethrough to a connected air discharge nozzle for blowing out loose debris from the pothole prior to filling it with asphalt, and wherein the two chambers are in contiguous relationship for thermal contact therebetween.

25. A pothole patching vehicle according to claim 24, wherein the tamper means includes heating means to provide heated gas to the lower chamber for heating the tamper plate and thereby ironing freshly laid asphalt in order to provide a smooth and continuous new asphalt patch.

26. A pothole patching vehicle according to claim 25, further comprising a downwardly and forwardly directed tack oil nozzle coupled to a tack oil storage tank mounted on the vehicle for pre-treating a pothole with a tack oil prior to filling the pothole with asphalt.

* * * * *